US005545072A

United States Patent [19]

Arad et al.

[11] Patent Number: 5,545,072

[45] Date of Patent: Aug. 13, 1996

[54] IMAGE PROJECTIVE TOY

[75] Inventors: Avi Arad, Westport, Conn.; Melvin Kennedy, Lantana, Fla.

[73] Assignee: Toy Biz, Inc., New York, N.Y.

[21] Appl. No.: 281,010

[22] Filed: Jul. 27, 1994

[51] Int. Cl.[6] ..... A63H 3/00; A63H 33/22; A63H 33/26

[52] U.S. Cl. ..... 446/268; 446/2.9; 446/485

[58] Field of Search ..... 446/268, 219, 446/198, 303, 465, 485, 484, 268

[56] References Cited

U.S. PATENT DOCUMENTS 3,531,891 10/1970 Goldfarb et al. ..... 446/303
4,489,939 12/1984 Spector ..... 446/198 X
4,756,614 7/1988 Kato et al. ..... 353/35
4,878,873 11/1989 Yamaguchi et al. ..... 446/219 X
5,118,319 6/1992 Smith et al. ..... 446/268 X
5,266,980 11/1993 Gussin et al. ..... 353/19
5,311,226 5/1994 Karasawa ..... 353/19

*Primary Examiner*—Robert A. Hafer
*Assistant Examiner*—D. Ned Muir
*Attorney, Agent, or Firm*—Robert F. Zielinski

[57] ABSTRACT

An image projecting toy comprised of a toy figure and an associated internally disposed projection system, the projection system including a disk assembly containing a segmented film element having a plurality of images which are transilluminated by an illumination source, the images being selectable by the user for projection of the same onto a proximately disposed viewing surface.

12 Claims, 4 Drawing Sheets

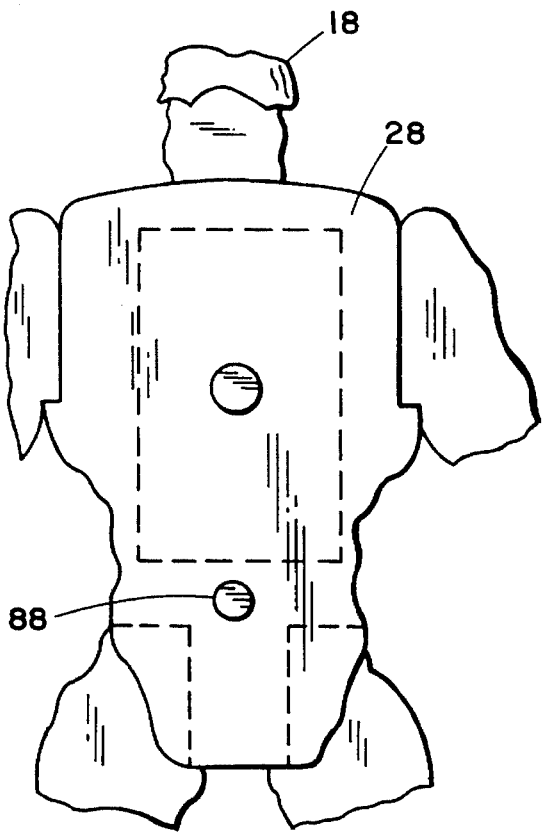
FIG. 3
FIG. 2
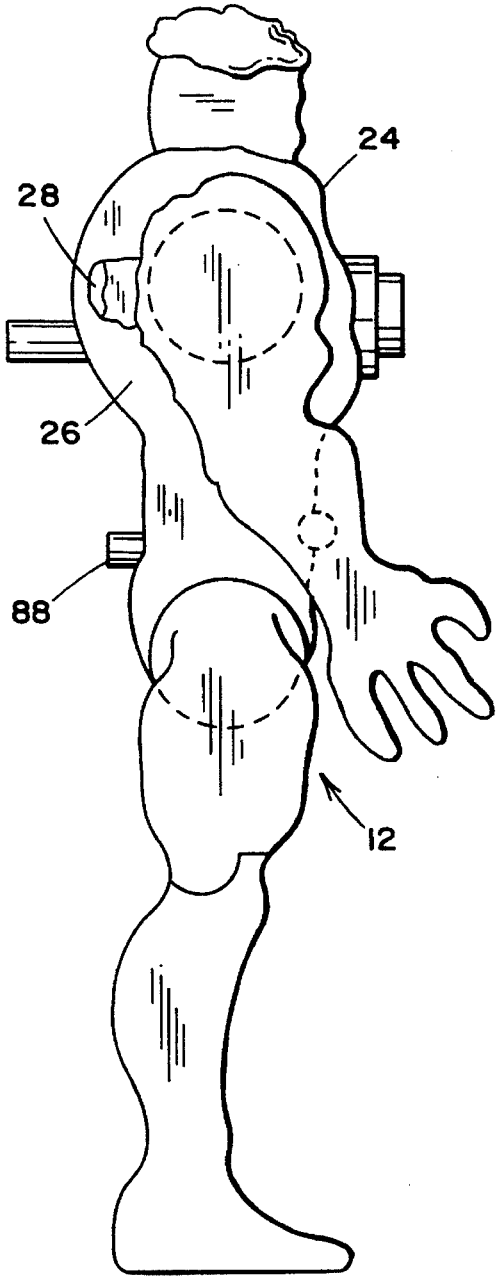

IMAGE PROJECTIVE TOY

FIELD OF THE INVENTION

The present invention relates generally to toy figures, and more particularly, to a toy figure having an internally disposed projection assembly for generating a plurality of images which may be selectively viewed by a child playing with the toy.

DESCRIPTION OF THE PRIOR ART

Although the general concept of projecting images contained on a film or transparency by transillumination and projection through a lens is well known, the prior art is devoid of any such capability implemented in combination with a toy action figure, particularly where the projection system provides for the selective projection of multiple images, either onto a proximately disposed surface or by placing an eye in front of the projection lens of the device.

Accordingly, it is a principal object of the present invention to provide an image projecting toy comprised of an articulated toy figure, characterizing a comic character known to children and having an internally associated projection system for generating a plurality of images to be projected from the figure onto a proximately disposed surface.

It is yet another object of the present invention to provide an image projecting toy wherein the projection system includes a segmented disk-shaped film element having a plurality of adjacent images disposed thereon which makeup individual elements of a comic strip related to the toy figure.

It is yet a further object of the present invention to provide an image projecting toy which allows a plurality of images to be projected and selected by manipulating an image selector assembly.

It is still another object of the present invention to provide an image projecting toy which offers greatly enhanced play value over typical prior art articulated toy figures.

SUMMARY OF THE INVENTION

In accordance with the above objects and additional objects which will become apparent hereinafter, the present invention provides an image projecting toy principally comprised of a toy figure having an internally associated projection assembly. The toy figure is articulating and embodies an action character such as for example, but not limited to, one of the characters in the "X-Men" comic series as depicted in the exemplary embodiment.

The toy figure includes a hinged chest portion to facilitate access to the projection assembly and a removable back panel to provide access to a battery compartment. The projection assembly comprises a rotatable disk assembly having a film element which contains a plurality of sequentially arranged images on adjacent segments which, for example, can replicate a comic strip or the like and which may or may not be related to the character embodied by the toy figure. These images are transilluminated by a bulb disposed in a parabolic-shaped reflector assembly resembling that of a flashlight which is optimally spaced from the disk assembly.

An image selector assembly is operatively coupled to the disk assembly to facilitate the rotation thereof relative to a lens assembly disposed in the chest portion of the figure. In this manner, the images contained on the disk may be selectively viewed by the child. The various images on the segments of the disk assembly are independently transilluminated by pressing a switching mechanism and simultaneously manipulating the image selector assembly.

BRIEF DESCRIPTION OF DRAWINGS

FIG. 2 is a right side elevational view thereof;

FIG. 3 is a partial rear elevational view thereof;

DETAILED DESCRIPTION OF THE PREFERRED EMBODIMENT

Figure 1:
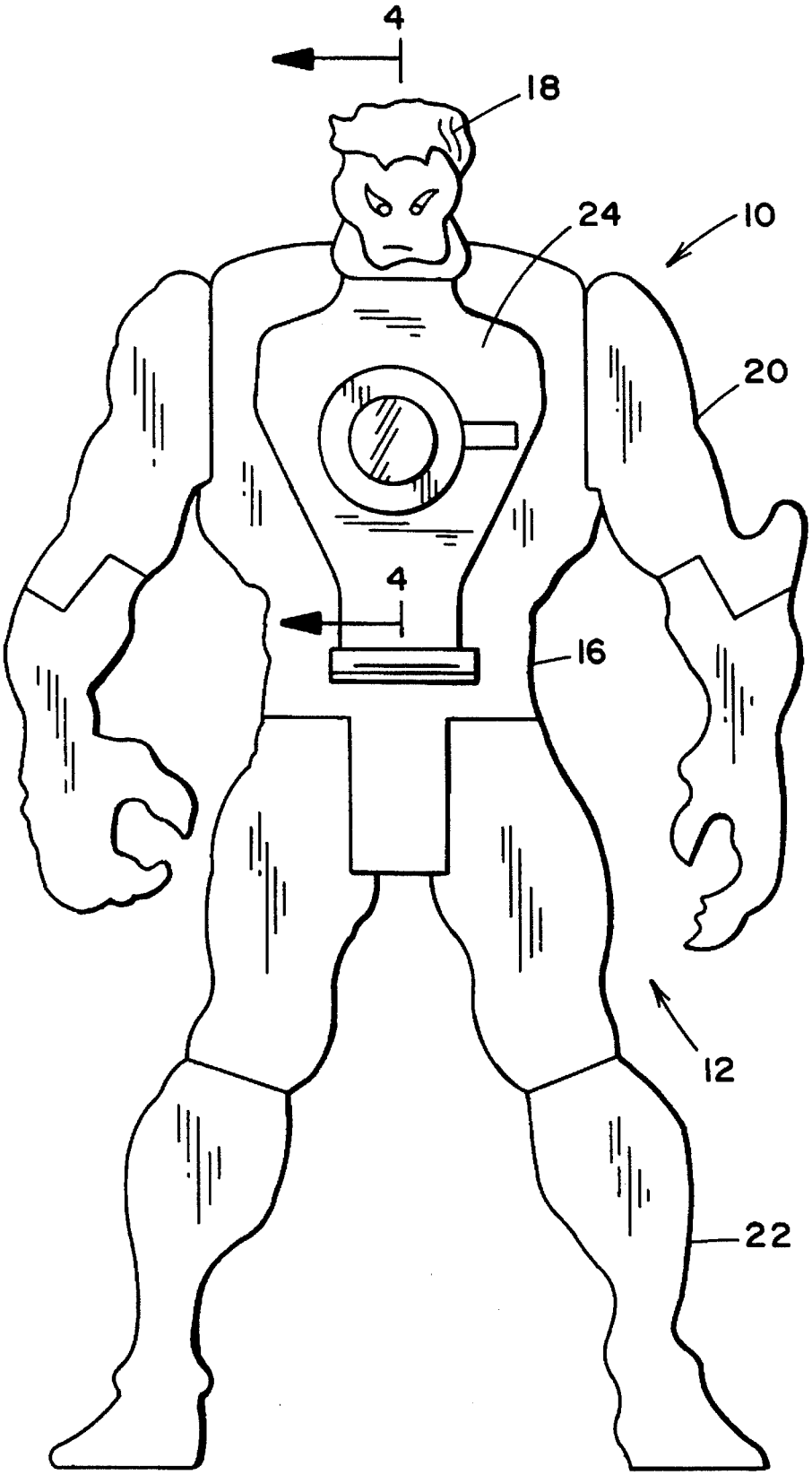
FIG. 1 is a front elevational view of a representative image projecting toy.

With reference to the several views of the drawings, there is depicted an image projecting toy generally denoted by the reference numeral 10, comprised of a toy figure 12 having an internally disposed projection system 14.

Referring now to the exemplary embodiment illustrated in FIGS. 1–3, the toy figure 12 is articulating and embodies an action character from the popular "X-Men" comic series. Of course, such depiction is merely illustrative and the type of characters embodied can be virtually unlimited depending upon the desired characterization. Toy figure 12 is principally comprised of a body 16, head 18, arms 20 and legs 22. The head 18, arms 20 and legs 22 can be made to be articulating relative to body 16 in a conventional manner by providing each with a retaining flange which is situated within a corresponding recess in the body. Body 16 includes a hinged chest 24 which can be made to pivot between an open position and a closed position to provide access to the projection system 14. Similarly, a removable rear panel 26 facilitates access to a rearwardly facing battery compartment 28.

Figure 4:
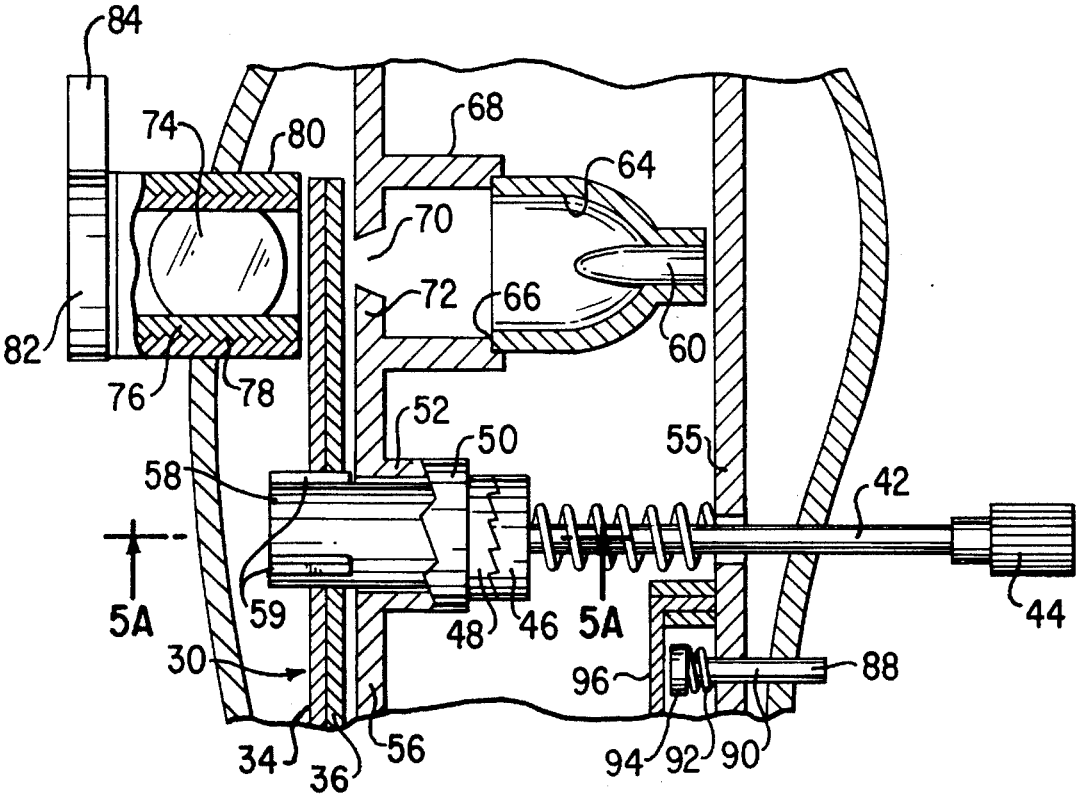
FIG. 4 is a sectional view taken along lines 4—4 in FIG. 1, depicting the projection system.
Figure 6:
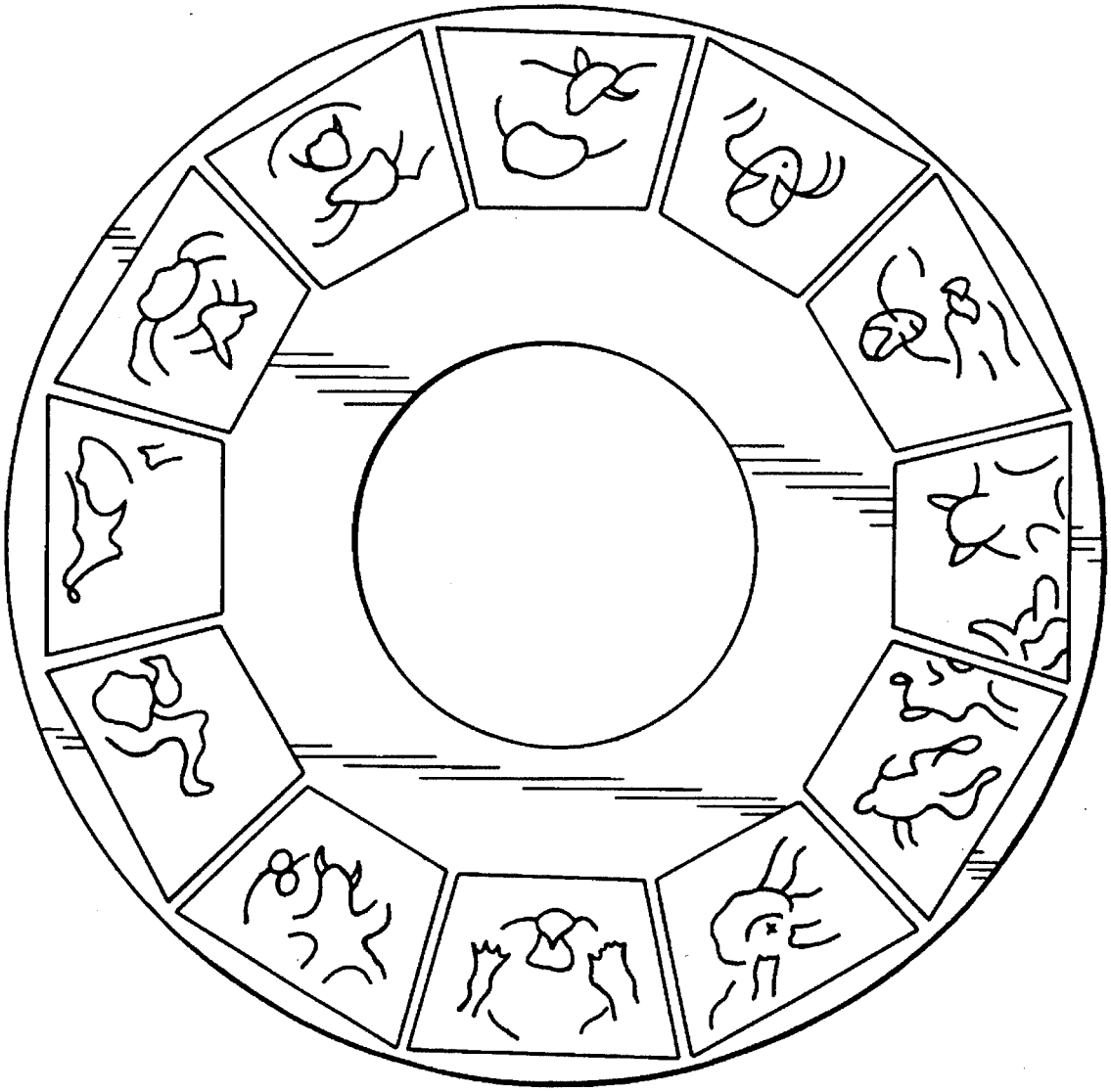
FIG. 6 is a detail view of the film disk assembly depicting a plurality of images sequentially arranged in a comic format for projection.

Referring now to FIGS. 4 and 6, projection system 14 comprises a substantially transparent disk assembly 30 containing, for example, a 35 mm film element 32 disposed and sandwiched between an outer transparent disk 34 and an inner transparent disk 36. Film element 32 is segmented into a plurality of adjacently positioned images 38. Disk assembly 30 defines a center aperture for attaching the same to an image selector assembly 40 to facilitate rotation of disk assembly 30 relative to a lens assembly to be described below.

Figure 5A:
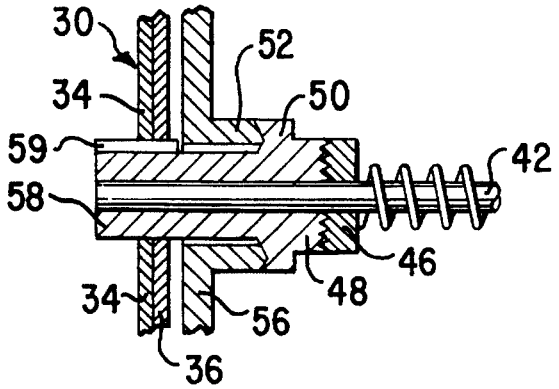
FIG. 5A is a sectional view taken along lines 5A—5A in FIG. 4, depicting details of the image selector assembly.
Figure 5B:
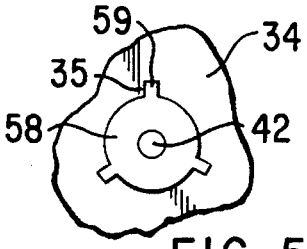
FIG. 5B is a plan view of the film disk assembly depicting the splined hub of the image selector assembly which facilitates proper angular orientation of the film disk assembly.

As shown in FIGS. 4 and 5, image selector assembly 40 comprises an elongated shaft 42 which extends rearwardly through an aperture in rear panel 26. A knurled knob 44 is provided on the exposed end of shaft 42 to facilitate grasping. A first clutch element 46 having a ratcheted clutch face is affixed to shaft 42 and engages a second clutch element 48. Clutch element 48 has an integral outer clutch ring 50 which similarly engages a clutch ring 52 integral with front wall 56. A compression spring 54 is disposed on shaft 42 and has one end residing against wall 55 to bias the one-way ratchet element 46 against the clutch element 48 to provide proper angular alignment of disk assembly 30 with respect to the lens assembly described below. In this regard, the compression spring 54 allows the hub to be depressed for rotation and biased rearwardly upon release to fix the location of each image in front of the lens. Additionally, the hub portion 58 may include a plurality of splines 59 to receive the disk assembly 30 in the appropriate orientation defined by corresponding slots 34 as shown in FIGS. 5A and 5B.

For backlighting the disk assembly 30, bulb 60 is disposed within a parabolic-shaped reflector 62 having an internal reflective surface 64. Reflector 62 is positioned with edge 66 thereof in engagement with the support sleeve 68. It has been determined during design and development of the exemplary embodiment, that spacing edge 66 from disk assembly 30 by approximately 0.500 in. provides excellent results. A window or aperture 70 having a beveled inner edge 72 is defined in front wall 56 and is collinearly aligned with bulb 60 and reflector 62. Light from bulb 60 transilluminates the particular image 38 aligned with aperture 70 for optical transmission through a lens assembly 74.

Lens assembly 74 is disposed within a ferrule 76 having a male threaded portion 78 for threadable connection to a sleeve 80 integral with chest 24, the sleeve having a corresponding female thread 82. The lens assembly 74 may comprise a unitary lens (as shown) or multiple lens elements, depending upon the imaging quality desired. In this manner, the user can grasp either the focus lever 84 or knurled portion 86 of ferrule 76 to translate the lens assembly 74 horizontally relative to the disk assembly 30 to focus the image.

Referring to FIGS. 2–4, battery compartment 28 is sized to an accept a pair of batteries in a conventional manner. A spring loaded push-on switch 88 enables illumination of bulb 60 to transilluminate images 38 on disk assembly 30. Switch 88 comprises a switch pin 90, compression spring 92, first contact 94 and second contact 96. In such an implementation, the switch is normally biased into an open position and consequently requires positive pressure thereon to activate the bulb for viewing the images. This prevents excessive battery drain which can occur with a conventional switch if inadvertently left in the "on" position, particularly when the toy figure 12 is situated in a well-lit room where it is difficult for the user to ascertain whether the projection system 14 is on or off. Of course, such an embodiment is merely exemplary and any conventional switch could be employed if so desired.

To enable projection system 14, the child closes switch 88, which in turn causes the particular image 38 on film element 32 which is aligned with aperture 70 and lens element 74 to be transilluminated and projected through lens element 74. If the surroundings are sufficiently dark, the image can be projected onto a surface such as a table or a wall for viewing, and focused by rotating the ferrule 76 within sleeve 80. Alternatively, the images may be viewed internally by placing the lens 74 directly in front of the eye. In all events, the ability to project images which may be related in some manner to the character of the toy figure, greatly increases the "play-value" and appeal of such a product to children.

The present invention has been shown and described in what is considered to be the most practical and preferred embodiment. It is anticipated, however, that departures may be made therefrom and that obvious modifications will occur to persons skilled in the art.

We claim:

1. An image projective toy, comprising:

a toy figure having a head member, a partially hollow body member and a plurality of appendage members extending from said body member, said body member further having a chest portion and a back portion; and a projection system wherein said projection system is housed substantially within said body member, said projection system comprising means for illuminating, film element means having more one image to be projected, rearwardly projecting control means for said film element means and lens means comprising a manipulable forwardly projecting focusing element for focusing at least one of said image to a variety of distances outside of said toy figure and further wherein said lens means is positioned through said chest portion of said toy figure and projects at least one of said image perpendicular relative said chest portion.

2. The image projecting toy recited in claim 1, wherein said film element includes a plurality of images sequentially arranged in a comic format.

3. The image projecting toy recited in claim 2, wherein said film element is disk-shaped and said toy further includes means for rotating said disk element relative to said means for focusing.

4. The image projecting toy of claim 3 wherein said means for rotating said disk element comprises a rotatable shaft member extending rearwardly from said back portion of said toy figure.

5. An image projectile toy, comprising:

an articulable toy figure with a generally upright orientation having a head portion, a body portion and a plurality of arm-like and leg-like appendages, said body portion having a front chest-like surface and a back surface; and projection system for projecting more than one image from a point within said toy figure to a variety of distances outside of said toy figure, said projection system comprising a film element having more than one image to be projected; control means for manipulating said film element means for illuminating said film element and lens means comprises a manipulable forwardly projecting focusing element extending outwardly from said body portion front surface for focusing said more than one image, wherein said projection system is positioned substantially within said body portion of said toy figure so that said more than one image is projected through the chest-like surface and horizontally relative to the generally upright position of said toy figure with said lens means projecting outwardly through said chest-like surface and said film element control means projecting rearwardly through said back surface.

6. The image projecting toy recited in claim 5, wherein said film element is disk-shaped and includes a plurality of images sequentially arranged in a comic format, and said toy further includes means for rotating said disk element to individually select each of said images for projection.

7. An image projector, comprising:

a toy figure comprising a three dimensional representation of an animation or comic book character, said toy figure having a front surface, a back surface, a head and appendages and an image projection system for projecting more than one image from a point within said toy figure to a variety of distances outside of said toy figure, said image projection system comprising: a singular light source for generating illumination disposed substantially within a parabolic-shaped reflector; a film element having a plurality of sequentially arranged images, said film element being disposed between said light source and lens means; said lens means comprising a manipulable forwardly projecting focusing element for focusing at least one projected image, and film element control means wherein said projection system is disposed substantially within said toy figure and further wherein said lens means extends outwardly from said front surface of said toy figure and said film element control means projects rearwardly through said back surface.

8. The image projector recited in claim 7, wherein said lens means further comprises means for selectively focusing said at least one image.

9. The image projector recited in claim 8, wherein said projection system further comprises a selectively operable switch for energizing said light source.

10. The image projector recited in claim 9, wherein said light source is a light bulb.

11. The image projector recited in claim 7, wherein said at least one image is the character of said toy figure.

12. The image projector recited in claim 7, wherein said at least one image is related to the character of said toy figure.

* * * * *